US009203142B2

(12) United States Patent
Zhu

(10) Patent No.: US 9,203,142 B2
(45) Date of Patent: Dec. 1, 2015

(54) MOBILE COMMUNICATION ANTENNA DEVICE AND MOBILE COMMUNICATION TERMINAL DEVICE

(71) Applicant: HUAWEI DEVICE CO., LTD., Shenzhen, Guangdong (CN)

(72) Inventor: Dejin Zhu, Wuhan (CN)

(73) Assignee: HUAWEI DEVICE CO., LTD., Shenzhen (CN)

( * ) Notice: Subject to any disclaimer, the term of this patent is extended or adjusted under 35 U.S.C. 154(b) by 191 days.

(21) Appl. No.: 13/627,250

(22) Filed: Sep. 26, 2012

(65) Prior Publication Data

US 2013/0082881 A1 Apr. 4, 2013

Related U.S. Application Data

(63) Continuation of application No. PCT/CN2011/072197, filed on Mar. 28, 2011.

(30) Foreign Application Priority Data

Mar. 26, 2010 (CN) ..... 2010 2 0144966 U

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/243* (2013.01); *H01Q 1/36* (2013.01); *H01Q 1/48* (2013.01); *H01Q 5/357* (2015.01); *H01Q 5/378* (2015.01); *H01Q 9/40* (2013.01); *H01Q 9/42* (2013.01)

(58) Field of Classification Search
CPC ... H01Q 1/243; H01Q 5/0051; H01Q 5/0062; H01Q 9/42
USPC ..... 343/702, 700 MS
See application file for complete search history.

(56) References Cited

U.S. PATENT DOCUMENTS 5,771,025 A * 6/1998 Reece et al. ..... 343/828
6,054,955 A * 4/2000 Schlegel et al. ..... 343/702
(Continued)

FOREIGN PATENT DOCUMENTS

CN 1423365 6/2003
CN 1667872 9/2005
(Continued)

OTHER PUBLICATIONS

International Search Report of Corresponding PCT Application PCT/CN2011/072197 mailed Jun. 2, 2011.
(Continued)

*Primary Examiner* — Hoang V Nguyen
(74) *Attorney, Agent, or Firm* — Staas & Halsey LLP

(57) ABSTRACT

The present invention discloses a mobile communication antenna device. The device includes: a monopole antenna, placed on one side of a printed circuit board, where a distance between the monopole antenna and a central position of the printed circuit board is less than a threshold, and the monopole antenna includes a first metal sheet which is vertical to the printed circuit board, and is conducted with a circuit of the printed circuit board through a feedpoint. The present invention also discloses a mobile communication terminal device. By adopting the present invention, an ultra wideband antenna may be achieved, thereby making it possible that a mobile communication terminal device product, such as a fixed station, supports more frequency bands.

10 Claims, 2 Drawing Sheets

(51) Int. Cl.

| | |
|---|---|
| ***H01Q 1/48*** | (2006.01) |
| ***H01Q 9/40*** | (2006.01) |
| ***H01Q 9/42*** | (2006.01) |
| ***H01Q 1/36*** | (2006.01) |
| ***H01Q 5/357*** | (2015.01) |
| ***H01Q 5/378*** | (2015.01) |

(56) References Cited

U.S. PATENT DOCUMENTS

| | | | | |
|---|---|---|---|---|
| 7,095,374 | B2 * | 8/2006 | Chen et al. | 343/702 |
| 7,289,070 | B2 * | 10/2007 | Yanagi et al. | 343/702 |
| 7,408,511 | B2 | 8/2008 | Liu | |
| 7,714,786 | B2 * | 5/2010 | Chen et al. | 343/700 MS |
| 2005/0088341 | A1 * | 4/2005 | Yang | 343/700 MS |
| 2006/0055616 | A1 | 3/2006 | Heyde et al. | |
| 2007/0176829 | A1 | 8/2007 | Liu et al. | |
| 2009/0167622 | A1 | 7/2009 | Yanagisawa et al. | |

FOREIGN PATENT DOCUMENTS

| | | |
|---|---|---|
| CN | 1797844 | 7/2006 |
| CN | 2919558 | 7/2007 |
| CN | 101072061 | 11/2007 |
| CN | 201038307 | 3/2008 |
| CN | 201616506 | 10/2010 |
| GB | 2236625 | 4/1991 |
| JP | 5259724 | 10/1993 |

OTHER PUBLICATIONS

Extended European Search Report, dated Nov. 22, 2012, in corresponding European Application No. 11758817.8 (5 pp.).

International Search Report issued Jun. 2, 2011 in corresponding International Patent Application No. PCT/CN2011/072197.

Written Opinion of the International Searching Authority issued Jun. 2, 2011 in corresponding International Patent Application No. PCT/CN2011/072197.

"*The Design of the cross semi-elliptic disc monopole antenna and the band-rejected cross semi-elliptic monopole antenna for UWB Applications*"; Wen-Shan Chen, Mao-Kai Hsu, Kai-Nan Yang, Hsin-Cheng Su, and Hua-Ming Chen; Department of Electronic Engineering Southern Taiwan University of Technology, Yung-Kang city, Tainan Hsien, 710 Taiwan, R.O.C.; 2006 IEEE (4 pages).

* cited by examiner

MOBILE COMMUNICATION ANTENNA DEVICE AND MOBILE COMMUNICATION TERMINAL DEVICE

CROSS-REFERENCE TO RELATED APPLICATIONS

This application is a continuation of International Application No. PCT/CN2011/072197, filed on Mar. 28, 2011, which claims priority to Chinese Patent Application No. 201020144966.X, filed on Mar. 26, 2010, both of which are hereby incorporated by reference in their entireties.

FIELD OF THE INVENTION

The present invention relates to the field of communications technologies, and in particular, to a mobile communication antenna device and a mobile communication terminal device.

BACKGROUND OF THE INVENTION

With the development of wireless communications technologies, wireless performance of a terminal device becomes very important. Meanwhile, a miniaturization tendency of the terminal device further makes that an antenna, which is used to transmit and receive wireless signals, increasingly urgently needs to be converted from a traditional external form to a built-in form. However, due to an environment limitation, an existing form of built-in antenna is much poorer than an external antenna in terms of bandwidth, gain, and un-roundness of a pattern of a horizontal plane, which results in a decline in user satisfaction. Therefore, how to improve related performance specifications of a built-in antenna device becomes extremely urgent.

In the prior art, for most built-in antennas, a form of printing an antenna at an edge of a PCB (Printed Circuit Board, printed circuit board) is adopted. That is, an area is reserved at the edge of the PCB, and in this area, no component is placed, and there is also no wiring and ground, and an antenna is printed in this area, thereby achieving wireless communications. A separated printed antenna may also be adopted, and is electrically connected to the PCB, thereby achieving wireless communications. However, because the printed antenna and the PCB are on a same horizontal plane, for the antenna, there is a very small vertical polarization component and a large horizontal polarization component. However, in a case that wireless signals in a rural area are mainly vertically polarized, a bandwidth, a gain, and un-roundness of a pattern of a horizontal plane of the antenna are undesirable, which results in poor user experience.

Therefore, a built-in antenna is proposed in the prior art, and is implemented by adopting a manner of placing a monopole antenna or a PIFA (Planar Inverted-F Antenna, PIFA antenna) at an edge of a PCB and adding a passive parasitic unit at the same time. That is, a bright copper area which is grounded is added beside a feedpoint of the monopole antenna or the PIFA antenna, and a metal sheet or a FPC (Flexible Printed Circuit, flexible printed circuit) whose length is close to one quarter of a wavelength of a desired frequency band is connected to the bright copper area through a spring. In a manner of coupling resonance of the grounded metal sheet or the FPC, the bandwidth is broadened, so that it is achieved that the antenna works in several normal frequency bands adopted by GSM850 (GSM, Global System for Mobile communications, global system for mobile communications), GSM900, DCS (Distributed Control System, distributed control system), PCS (Personal Communications Service, personal communications service), UMTS2100 (UMTS, Universal Mobile Telecommunication System, universal mobile telecommunication system), and so on.

In the process of implementing the present invention, the inventor finds that the prior art has the following problems.

The bandwidth of the antenna can only meet specification requirements, the gain of the antenna is hard to be increased, and the un-roundness of the pattern of the horizontal plane is difficult to be improved. As a result, the user experience is still poor.

SUMMARY OF THE INVENTION

An embodiment of the present invention provides a mobile communication antenna device, which is used to increase a bandwidth of an antenna, enhance a gain of the antenna, and improve un-roundness of a pattern of a horizontal plane of the antenna. The device includes:

- a monopole antenna, placed on one side of a printed circuit board, where a distance between the monopole antenna and a central position of the printed circuit board is less than a threshold, and the monopole antenna includes:
- a first metal sheet, vertical to the printed circuit board, and conducted with a circuit of the printed circuit board through a feedpoint.

An embodiment of the present invention also provides a mobile communication terminal device, which is used to increase a bandwidth of an antenna, enhance a gain of the antenna, and improve un-roundness of a pattern of a horizontal plane of the antenna. The device includes the foregoing mobile communication antenna device.

In the embodiments of the present invention, the monopole antenna is placed on one side of the printed circuit board, where a distance between the monopole antenna and the central position of the printed circuit board is less than the threshold. The monopole antenna includes the first metal sheet, which is vertical to the printed circuit board, and conducted with the circuit of the printed circuit board through the feedpoint, so that an antenna mirror with the printed circuit board as a mirror surface is achieved. In this case, on the other side of the printed circuit board, there is a mirror image monopole antenna, which, together with the existing monopole antenna, forms a dipole antenna. Because the dipole antenna is much less affected by the printed circuit board than a monopole antenna or a PIFA antenna, where the monopole antenna or the PIFA antenna is placed at an edge of the printed circuit board in the prior art, its gain is high and its un-roundness of a pattern of a horizontal plane is improved; moreover, the bandwidth of the antenna may be made to be higher, so that GPS and Bluetooth frequency bands may be covered without the need of adding new GPS and Bluetooth antennas, thereby reducing the cost.

BRIEF DESCRIPTION OF THE DRAWINGS

To illustrate the technical solutions according to the embodiments of the present invention or in the prior art more clearly, accompanying drawings required for describing the embodiments or the prior art are introduced briefly in the following. Apparently, the accompanying drawings in the following description are only some embodiments of the present invention, and persons of ordinary skill in the art may further obtain other drawings according to the accompanying drawings without creative efforts. In the accompanying drawings.

DETAILED DESCRIPTION OF THE EMBODIMENTS

In order to make the objectives, technical solutions, and advantages of the embodiments of the present invention more comprehensible, the embodiments of the present invention are further described in detail in the following with reference to the accompanying drawings. Here, the exemplary embodiments of the present invention and descriptions are used to explain the present invention, but not intended to limit the present invention.

An embodiment of the present invention provides a new form of built-in antenna, so that a working frequency band of the antenna cover frequency bands which are adopted by GSM850, GSM900, DCS, PCS, UMTS2100, GPS, Bluetooth, and so on and are currently commonly used by mobile communication terminal devices. Meanwhile, a gain of the antenna can reach that of a conventional external antenna. Especially, compared with an existing form of built-in antenna, un-roundness of a pattern of a horizontal plane of the antenna is greatly improved.

Figure 1:
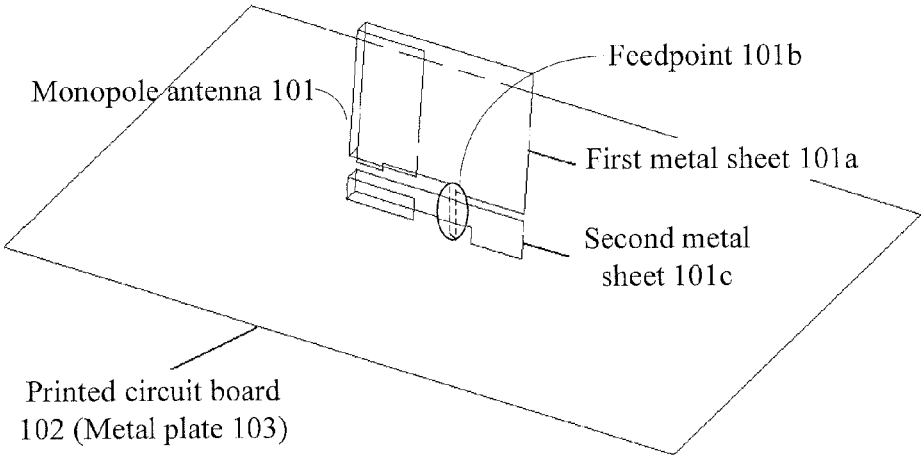
FIG. 1 is a schematic structural diagram of a mobile communication antenna device according to an embodiment of the present invention.

As shown in FIG. 1, an mobile communication antenna device according to an embodiment of the present invention may include:

- a monopole antenna 101, placed on one side of a printed circuit board 102, where a distance between the monopole antenna 101 and a central position of the printed circuit board 102 is less than a threshold, and the monopole antenna 101 includes:
- a first metal sheet 101*a*, vertical to the printed circuit board 102, and conducted with a circuit of the printed circuit board 102 through a feedpoint 101*b*.

It may be known from a structure of the mobile communication antenna device shown in FIG. 1 that, in the embodiment of the present invention, the monopole antenna 101 is placed on one side of the printed circuit board 102, where the distance between the monopole antenna 101 and the central position of the printed circuit board 102 is less than the threshold. The monopole antenna 101 includes the first metal sheet 101*a*, which is vertical to the printed circuit board 102, and conducted with the circuit of the printed circuit board 102 through the feedpoint 101*b*, so that an antenna mirror with the printed circuit board as a mirror surface is achieved. In this case, on the other side of the printed circuit board, there is a mirror image monopole antenna, which, together with the existing monopole antenna, forms a dipole antenna. Because the dipole antenna is much less affected by the printed circuit board than a monopole antenna or a PIFA antenna, where the monopole antenna or the PIFA antenna is placed at an edge of the printed circuit board in the prior art, its gain is high and its un-roundness of a pattern of a horizontal plane is improved; moreover, a bandwidth of the antenna may be made to be higher, so that GPS and Bluetooth frequency bands may be covered, and sharing of a main antenna and GPS and Bluetooth antennas is achieved without the need of adding new GPS and Bluetooth antennas, thereby reducing the cost.

In specific implementation, that the distance between the monopole antenna 101 and the central position of the printed circuit board 102 is less than the threshold may be that the monopole antenna 101 is approximately placed in the central position of the printed circuit board 102. That is, distances between the monopole antenna 101 and two long sides of the printed circuit board 102 are substantially the same, and distances between the monopole antenna 101 and two short sides of the printed circuit board 102 are also substantially the same. In this manner, a mirror effect of the printed circuit board may be utilized, the bandwidth of the antenna is increased, the gain of the antenna is enhanced, and the un-roundness of the pattern of the horizontal plane of the antenna is improved.

In specific implementation, the printed circuit board in FIG. 1 may be combined with other metal objects with various shapes and functions to form a metal plate 103. The monopole antenna 101 is placed on one side of the metal plate 103, where a distance between the monopole antenna 10 and a central position of the metal plate 103 is less than a threshold. The first metal sheet 101*a* is a main body portion of the monopole antenna 101, is vertical to the metal plate 103, and is conducted with a circuit of the metal plate 103 through the feedpoint 101*b*, so as to feed to transmit and receive wireless signals.

Figure 2:
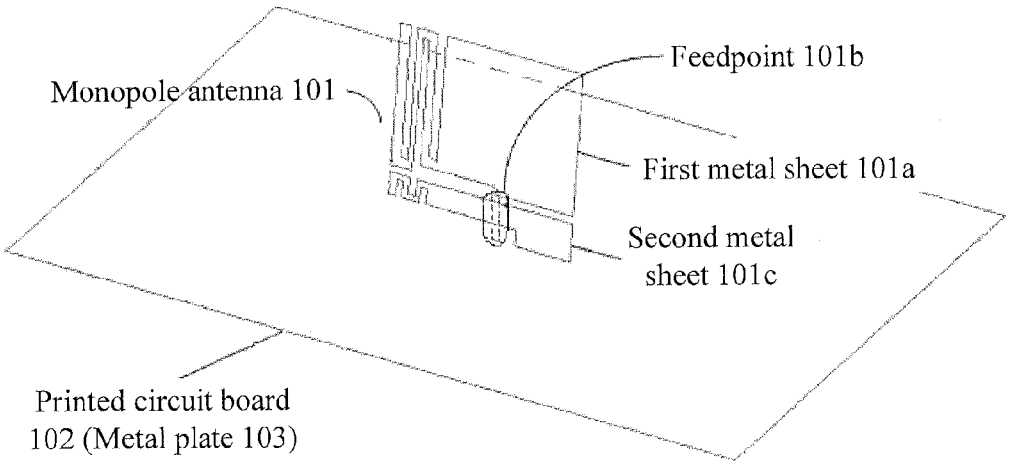
FIG. 2 is another schematic structural diagram of a mobile communication antenna device according to an embodiment of the present invention.

In an embodiment, as shown in FIG. 1, in order to save antenna space, one side that is of the first metal sheet and is vertical to the printed circuit board may be placed in a folded manner. Certainly, in order to save the antenna space, other shapes may also be adopted for one side that is of the first metal sheet and is vertical to the printed circuit board. For example, as shown in FIG. 2, one side that is of the first metal sheet and is vertical to the printed circuit board is disposed to form multiple serpentine grooves. In this manner, a length of the first metal sheet is extended in limited space, so that a purpose that the antenna resonates at a lower frequency without increasing the size of the antenna is achieved.

In specific implementation, the monopole antenna 101 shown in FIG. 1 may further include:

- a second metal sheet 101*c*, placed between the printed circuit board 102 and the first metal sheet 101*a*, and vertical to the printed circuit board 102, where one side that is parallel with and close to the printed circuit board 102 is conducted with a ground point of the printed circuit board 102, and one side that is parallel with and away from the printed circuit board 102 is hanged in the air.

In this manner, as a parasitic unit of the monopole antenna, the second metal sheet may resonate at an antenna frequency close to that of the first metal sheet, or in an absolutely different frequency band by being coupled to the first metal sheet, so as to broaden the bandwidth of the antenna.

In an embodiment, in order to save antenna space, one side that is of the second metal sheet and is vertical to the printed circuit board may also be placed in a folded manner, or, as shown in FIG. 1, one side that is of the second metal sheet and is vertical to the printed circuit board is disposed to form multiple serpentine grooves. In this manner, a length of the second metal sheet is extended in limited space, so that a purpose that the antenna resonates at a lower frequency without increasing the size of the antenna is achieved.

In addition, in order to tune wireless performance of the antenna, a length and a width of a gap between the first metal sheet and the second metal sheet may be adjusted according to wireless performance required by the mobile communication antenna device. Because a capacitance effect exists in the gap between the first metal sheet and the second metal sheet, when the length and the width of the gap are adjusted, a capacitance value is changed accordingly, so that the wireless performance of the antenna changes accordingly. Here, the wireless performance may include a voltage standing wave ratio, return loss, a gain, and efficiency of the antenna, and so on.

Similarly, a length and a width of a gap between the second metal sheet and the printed circuit board are adjusted according to the wireless performance required by the mobile communication antenna device, so that the wireless performance of the antenna is positively finely adjusted.

An embodiment of the present invention also provides a mobile communication terminal device, where the device may include the foregoing mobile communication antenna device. In this manner, an antenna bandwidth of the mobile communication terminal device may be increased; through implementing an ultra wideband antenna, it is possible that a mobile communication terminal device product, such as a fixed station, can support more frequency bands; in addition, a gain of the antenna may also be enhanced, and un-roundness of a pattern of a horizontal plane of the antenna is improved.

Besides the fixed station, the solution according to the embodiment of the present invention may also be applied to other small-sized mobile communication terminal device products, such as product forms including a wireless AP (Access Point, wireless access node, session point, or access bridge), an FMC (Fixed Mobile Convergence, convergence of a fixed network and a mobile network) terminal, and a digital photo frame.

Figure 3:
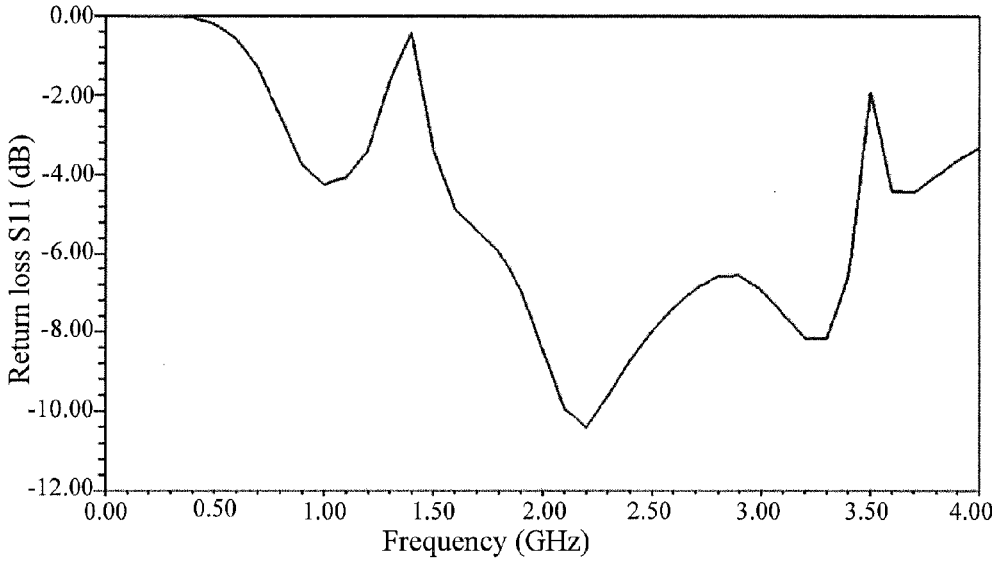
FIG. 3 is a schematic diagram of an antenna return loss result obtained by emulating a mobile communication antenna device according to an embodiment of the present invention.

FIG. 3 is a schematic diagram of an antenna return loss result obtained by emulating a mobile communication antenna device. It may be known from FIG. 3 that, in the embodiment of the present invention, it may be implemented that a frequency band of the mobile communication antenna device covers 824-960 MHz and 1710-2484 MHz, thereby meeting requirements for frequency bands which are adopted by GSM850, GSM900, DCS, PCS, UMTS2100, GPS, Bluetooth, and so on and are currently commonly used by terminal devices. Meanwhile, a gain of the antenna can reach that of a conventional external antenna. Especially, compared with an existing form of built-in antenna, un-roundness of a pattern of a horizontal plane of the antenna is greatly improved, so that a user experience effect is greatly improved. In the embodiment of the present invention, a structure is simple and easy to be implemented, and the cost is low.

To sum up, in the embodiments of the present invention, the monopole antenna is placed in a preset range, where the distance between the monopole antenna and the central position of the printed circuit board is less than the threshold, and a metal parasitic ground conducted with the printed circuit board is adopted, so that an ultra wideband antenna is achieved, which makes it possible that a mobile communication terminal device product, such as a fixed station, supports more frequency bands; a high gain of the antenna of the mobile communication terminal device product, such as the fixed station, is achieved, and the un-roundness of the pattern of the horizontal plane of the antenna is improved; sharing between a main antenna and GPS and Bluetooth antennas is achieved, thereby reducing the cost of the antenna. In addition, the second metal sheet is further disposed between the printed circuit board and the first metal sheet, and, as a parasitic unit of the monopole antenna, resonates at an antenna frequency close to that of the first metal sheet, or in an absolutely different frequency band by being coupled to the first metal sheet, so as to broaden the bandwidth of the antenna.

The objectives, technical solutions, and beneficial effects of the present invention are described in further detail through the foregoing specific embodiments. It should be understood that, the foregoing descriptions are merely specific embodiments of the present invention, but not intended to limit the protection scope of the present invention. Any modification, equivalent replacement, or improvement made without departing from the spirit and principle of the present invention should fall within the protection scope of the present invention.

What is claimed is:

1. A mobile communication antenna device, comprising:

a monopole antenna, placed on one side of a printed circuit board, wherein a distance between the monopole antenna and a central position of the printed circuit board is less than a threshold, the monopole antenna includes:

a first metal sheet, vertical to the printed circuit board, and conducted through a feedpoint with a circuit of the printed circuit board, a second metal sheet, placed between the printed circuit board and the first metal sheet, and vertical to the printed circuit board, wherein one side of the second metal sheet that is parallel with the first metal sheet is closer to the printed circuit board and is conducted with a ground point of the printed circuit board than another side of the second metal sheet that is parallel to the first metal sheet and is hanged in air.

2. The mobile communication antenna device according to claim 1, wherein one side that is of the first metal sheet and is vertical to the printed circuit board is placed in a folded manner or disposed to form multiple serpentine grooves.

3. The mobile communication antenna device according to claim 2, wherein the one side that is of the second metal sheet and is vertical to the printed circuit board is placed in a folded manner or disposed to form multiple serpentine grooves.

4. The mobile communication antenna device according to claim 2, wherein a length and a width of a gap between the first metal sheet and the second metal sheet are adjustable according to wireless performance required by the mobile communication antenna device.

5. The mobile communication antenna device according to claim 2, wherein a length and a width of a gap between the second metal sheet and the printed circuit board are adjustable according to wireless performance required by the mobile communication antenna device.

6. The mobile communication antenna device according to claim 1, wherein the threshold is configured so the monopole antenna is approximately placed in the central position of the printed circuit board where distances between the monopole antenna and sides of the printed circuit board are substantially same.

7. The mobile communication antenna device according to claim 1, wherein the one side that is of the second metal sheet and is vertical to the printed circuit board is placed in a folded manner or disposed to form multiple serpentine grooves.

8. The mobile communication antenna device according to claim 1, wherein a length and a width of a gap between the first metal sheet and the second metal sheet are adjustable according to wireless performance required by the mobile communication antenna device.

9. The mobile communication antenna device according to claim 1, wherein a length and a width of a gap between the second metal sheet and the printed circuit board are adjustable according to wireless performance required by the mobile communication antenna device.

10. A mobile communication terminal device, comprising a mobile communication antenna device according to claim 1.

* * * * *